United States Patent [19]

McCarthy et al.

[11] 4,165,993

[45] Aug. 28, 1979

[54] METHOD OF FLUE AND FIREPLACE CLEANING AND APPARATUS USED THEREIN

[76] Inventors: Daniel F. McCarthy; Carolann L. McCarthy, both of 33 Ezra St., North Haven, Conn. 06473

[21] Appl. No.: 834,800

[22] Filed: Sep. 19, 1977

[51] Int. Cl.[2] ..... B08B 5/04; B08B 9/00; B08B 9/04; B08B 7/04

[52] U.S. Cl. ..... 134/21; 134/22 C; 134/24; 134/37; 15/302; 15/320; 285/192; 126/138

[58] Field of Search ..... 134/21, 22 C, 24, 37; 15/302, 320, 301, 312 R, 312 A; 285/192

[56] References Cited

U.S. PATENT DOCUMENTS

| | | | |
|---|---|---|---|
| 263,349 | 8/1882 | Opper et al. | 134/22 C |
| 357,309 | 2/1887 | Doehring | 15/301 |
| 1,465,711 | 8/1923 | Gray | 134/10 |
| 1,589,986 | 6/1926 | Russell | 134/21 |
| 1,796,878 | 3/1931 | Watson | 134/24 |
| 3,215,560 | 11/1965 | Kredit | 134/21 |
| 3,479,679 | 11/1969 | Vogel | 15/302 |
| 3,533,840 | 10/1970 | Holm | 134/22 C |

*Primary Examiner*—Joseph Scovronek
*Assistant Examiner*—C. Konkol
*Attorney, Agent, or Firm*—DeLio and Montgomery

[57] ABSTRACT

The method of flue and fireplace cleaning includes the preparatory steps, if needed, of cleaning out ashes from a pit or sump, followed by connecting a vacuum hose to a low point in each system and spraying an industrial type detergent steam spray through a steam hose from the top of the chimney downward, loosening all sooty deposits in the form of a wet slurry which is collected and removed through the vacuum hose. A fireplace is cleaned by a similar steam spray and vacuum operation after sealing the fireplace opening by means of a tight-fitting shield having openings for the steam and vacuum conduits. In flue cleaning the vacuum hose is connected by means of an adaptor having an inwardly projecting ledge which intercepts falling debris and directs it into the hose, and in industrial installations the vacuum removal system may be replaced by a removable receptacle occupying the bottom of a stack in a position to receive the debris from periodic steam cleaning operations.

5 Claims, 6 Drawing Figures

METHOD OF FLUE AND FIREPLACE CLEANING AND APPARATUS USED THEREIN

This invention relates to a method of flue and fireplace cleaning using a detergent steam spray operated downward from the top of a chimney or introduced through a shield into a closed fireplace, with removal of the debris, in the form of a wet slurry, by means of a vacuum hose, the vacuum hose adapter and fireplace shield being designed with special features adapting them to this use.

It is customary for smoke-bearing flues to be cleaned by means of brushing devices which loosen most, but not all, of the accumulated soot for removal in some manner from the lower end of the flue. As a modification of that method, Stuart U.S. Pat. No. 968,207 (1910) shows a revolving head on a rubber hose, to be drawn (or pushed) upward from the bottom of a chimney while air under considerable pressure is delivered in jets against the inner wall of the chimney to loosen the soot deposited thereon, but no means od disposal is shown. Methods and apparatus for cleaning ventilating and/or heating air ducts are disclosed in the patents of Stephens, U.S. Pat. No. 3,485,671; Kredit, U.S. Pat. No. 3,215,560; Brownfield, U.S. Pat. No. 2,156,370, and Gray, U.S. Pat. No. 1,465,711. Air streams with vacuum removal are used by Stephens, Kredit and Gray while Brownfield uses a water spray with no method of removal. The air ducts typically run horizontally or at other angles which may be partially vertical.

It is accordingly an object of the present invention to provide a method of flue and fireplace cleaning which uses a detergent bearing steam spray, formulated for complete removal of soot and the like, with provision for vacuum removal of the slurry created by the spray.

It is a further object of the invention to provide certain accessory devices to facilitate carrying out the method.

It is another object of the invention to provide certain improvements in the form and construction of the accessory devices and in the steps of the method whereby the above-named and other objects may effectively be attained.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

The steps of the method and the nature of the accessory devices used therewith will be disclosed by reference to the accompanying drawings, wherein.

Figure 2:
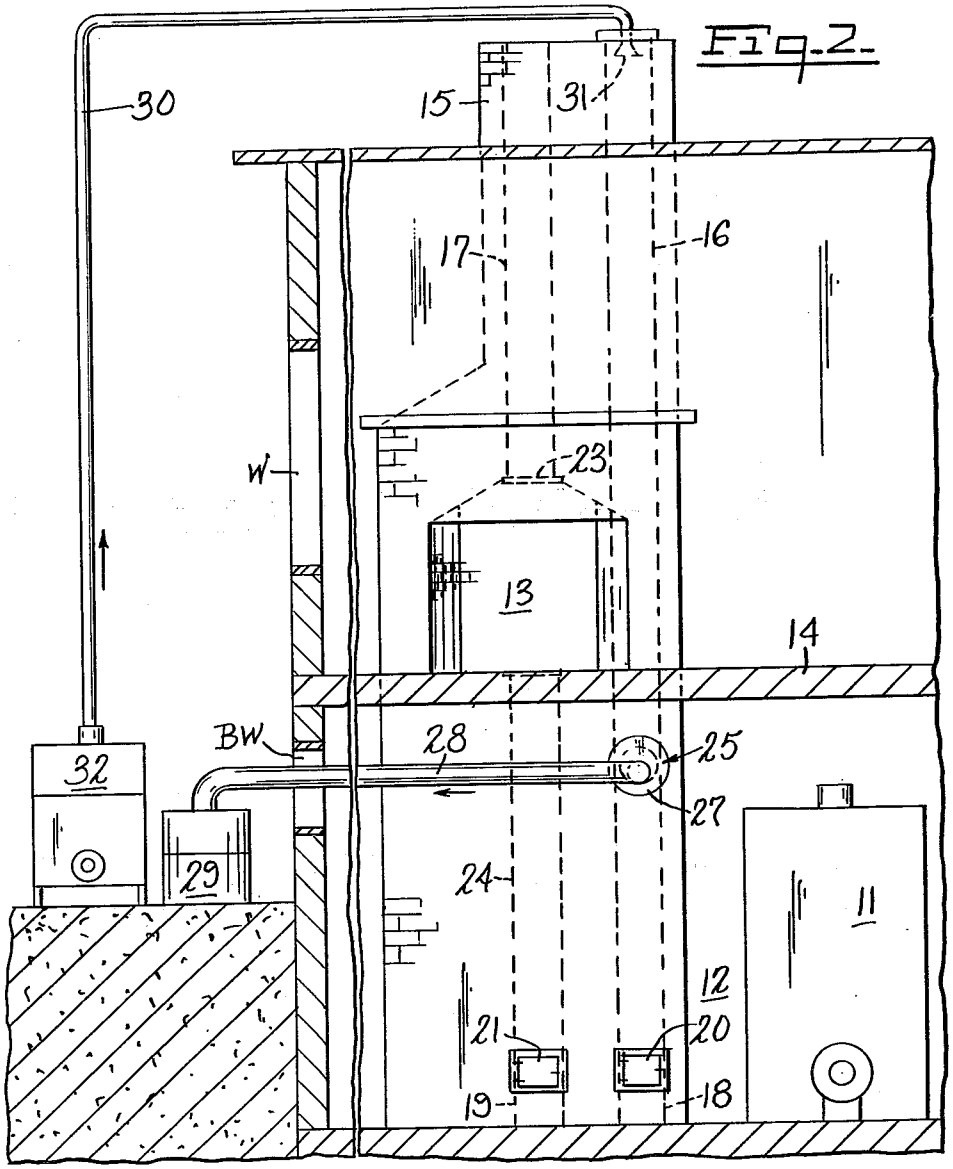
FIG. 2 represents a view corresponding to FIG. 1 with elements of the cleaning system in place for cleaning the furnace flue.
Figure 1:
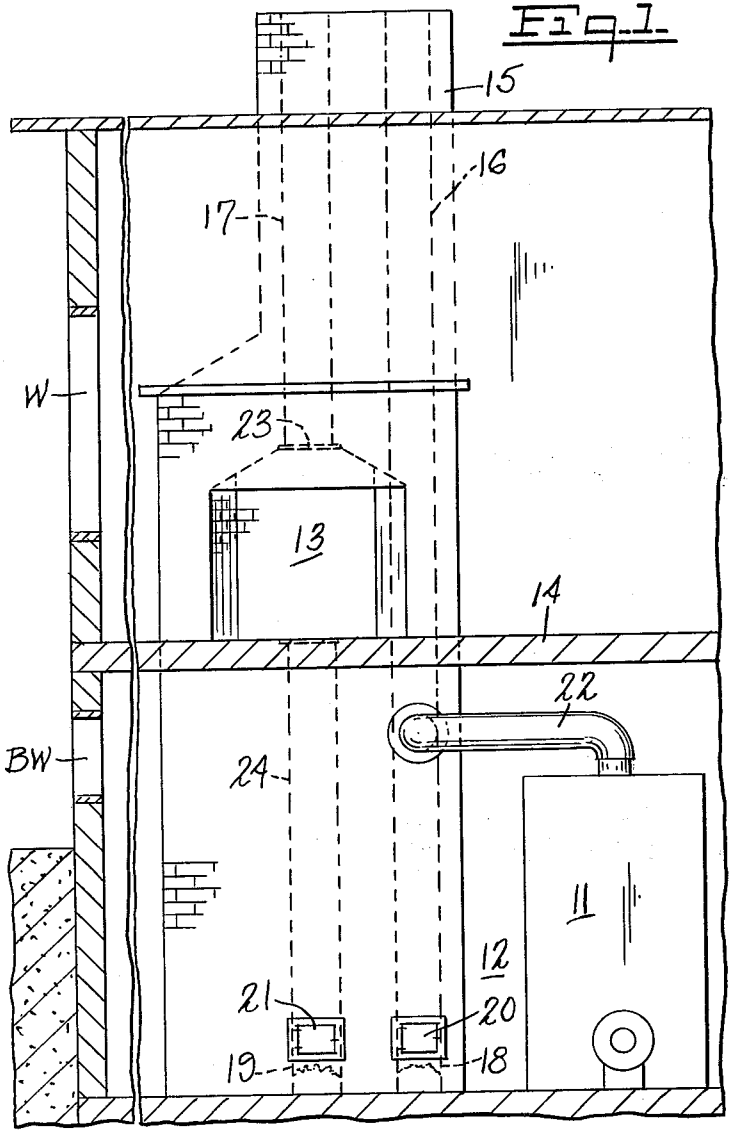
FIG. 1 represents a partial vertical section of a building showing, somewhat diagrammatically, features calling for the use of the cleaning method.
Figures 3, 4, 5, 6:
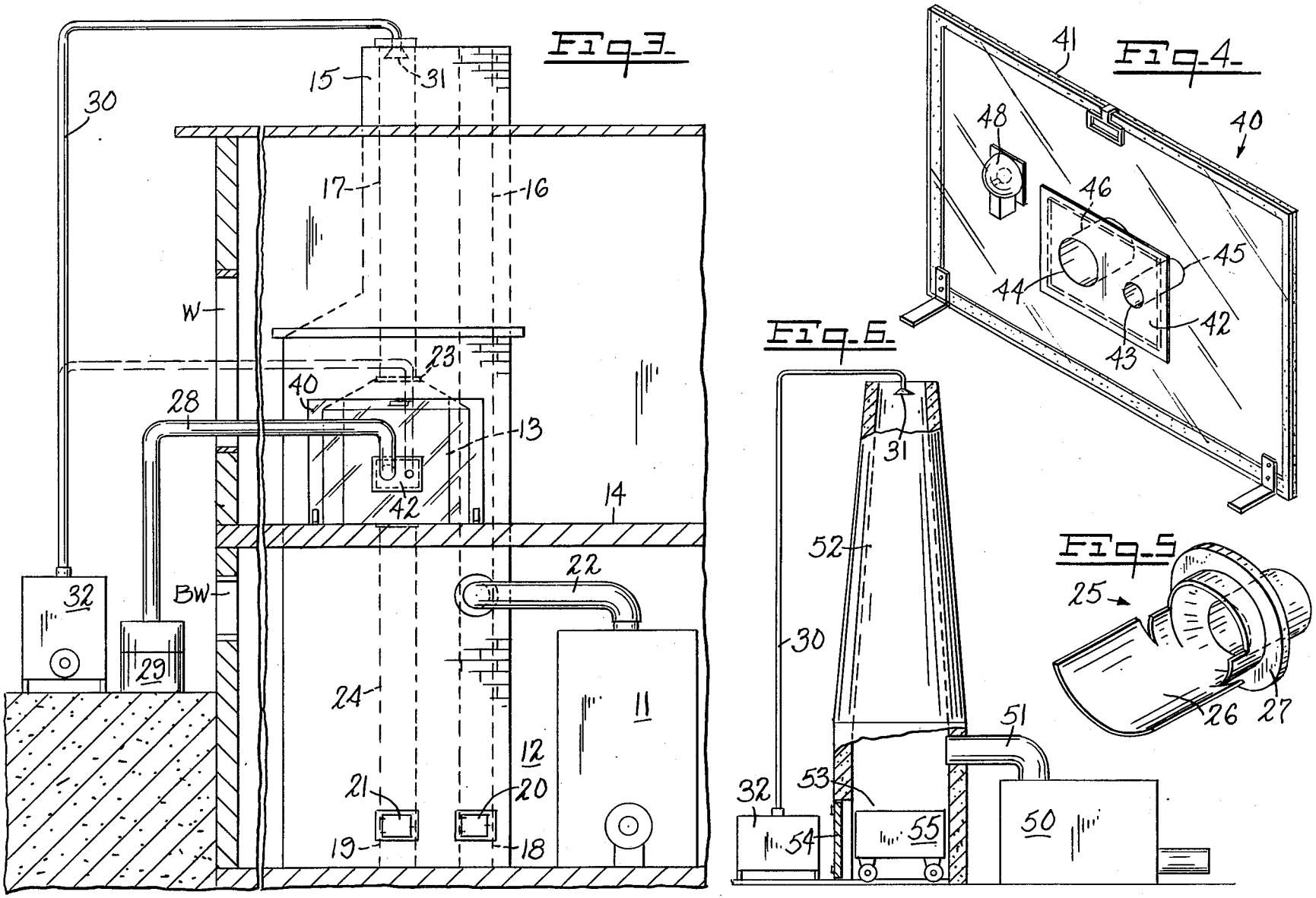
FIG. 3 represents a view corresponding to FIG. 1 with elements of the cleaning system, the fireplace and its flue.
FIG. 4 represents an isometric view of the fireplace shield.
FIG. 5 represents an isometric view of the adapter for connecting a vacuum hose to a furnace pipe.
FIG. 6 represents an elevation, partly in section, of a flue with alternative cleaning elements.

Referring to the drawings, there is shown in FIGS. 1, 2 and 3 a portion of a building having a combustion (oil, gas or coal) furnace 11 in the basement 12, a fireplace 13 on the floor 14 above the basement, and a chimney 15. The chimney is provided with separate flues 16, 17 serving the furnace and fireplace, respectively, the flue 16 extending into the base of the chimney where access to pit or sump 18, is provided by clean-out door 20. The furnace is connected to flue 16 by a conventional sheet metal furnace pipe 22. The flue 17 extends to the top rear of the fireplace and the throat of the fireplace may be closed, when desired, by a damper 23. An ash flue 24 extends from the floor of the fireplace to the pit or sump 19, to which access is gained through clean-out door 21.

The procedure for cleaning the furnace flue 16 is illustrated in FIG. 2 and includes the following steps:

The ashes in the pit or sump 18 are removed, as by shoveling, through the clean-out door 20 in a customary manner, and the door is closed.

The furnace pipe 22 is removed and the adapter 25 (FIG. 5) is installed in the chimney opening with the arcuate ledge or scoop 26 occluding a substantial proportion of the flue area and with the collar 27 sealing tightly against the adjacent surface of the chimney. A vacuum hose 28 is connected, through the basement window BW, between the adapter and a vacuum cannister 29, preferably outside the house and normally installed in a truck or the like, not shown.

The steam hose 30, equipped with a suitable nozzle 31 is led from the steam generator 32 (also normally installed in a truck or the like) to the top of the flue 16, and both the vacuum cannister 29 and steam generator 32 are activated, the nozzle 31 being gradually lowered down into the flue to a point near the adapter, whereupon the steam and vacuum are turned off, the equipment removed, and the cleaning has been completed.

The capabilities of the equipment are such that the steam generator can turn out about three gallons per minute of water, containing an entrained or dissolved detergent, while the wet-dry vacuum cannister has a capacity for drawing through the hose about one gallon of dust and water, as a vaporous slurry, per second. This excess of suction insures that all the steam, moisture and debris dislodged from the flue walls will be intercepted by the scoop 26 and withdrawn through the vacuum hose.

In order to clean a fireplace flue, as shown at 17, in FIG. 3, the fireplace opening is sealed by means of a heat resistant glass shield 40, sized to overlap substantially the sides and top of any normal fireplace (e.g. 55" by 33') and equipped with a resilient sealing flange 41 around the entire periphery. The center of the shield is cut out and closed by a rubber panel 42 in which openings 43, 44 are provided, for introduction of the steam and vacuum hoses, the openings being otherwise closed as by the self-closing sleeves 45, 46 and/or diaphragm closures.

The vacuum hose 28, entering the room through window W is fitted in the opening 44 and the steam hose 32 introduced into the top of the flue 17 (top of the chimney) and the steam and vacuum turned on to flush out the flue, the debris passing through the open damper and being largely removed by the vacuum hose. The shield is designed to prevent the escape of any debris into the room. Since the fireplace flue may be substantially shorter than the furnace flue, its steam-cleaning takes less time and produces less debris.

The fireplace itself can be quickly cleaned by introducing the steam hose, with a suitably modified nozzle, if desired, through the opening 43, closing the damper 23 and actuating the steam and vacuum units. The vacuum hose may be provided with a fitting enabling it to pick up debris and slurry from the floor of the fireplace, under manipulation from the outside of the shield. One or more battery-powered lighting devices 48 can be mounted on the shield to facilitate observation of conditions within the fireplace.

In FIG. 6 there is shown a modification wherein an industrial type furnace or boiler 50 is connected by pipe 51 to the chimney 52. In the base of the chimney is a lock chamber 53 having a door 54 and being designed to accommodate, with a close fit, a receptacle 55, shown as a cart on wheels. The steam generator 32, with hose 30 and nozzle 31 are used as previously described to wash down the flue of the chimney, the debris being collected in the cart 55 by which it is removed for disposal in any suitable manner. If a steam line is permanently installed on such a chimney, with a pulley-operated extendible hose at the top, steam cleaning can easily be effected at frequent intervals, with resultant reduction in air pollution, as well as reducing the need for scrubbers.

Different buildings will be found to contain different arrangements of heating elements, including flues, sumps, dampers and heat sources, but the detergent steam and vacuum units used typically as described above are adaptable to almost every situation. The detergent used in the steam will generally be an industrial-type chemical, selected for its ability to loosen and dislodge solid products of combustion. The cleaning operation can be carried out relatively neatly because of the immediate removal of the debris by the high volume vacuum pick-up arrangement, and the cleaning is both quicker and more complete then any cleaning, with brushes and the like.

Brush cleaning of a normal residential chimney may take from one to three hours, whereas the method described above can reduce this time to a fraction of that now required.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

What we claim is:

1. The method of chimney cleaning which includes, providing a source of detergent-bearing steam under pressure, providing a source of high volume wet-and-dry vacuum, said steam source being adapted to deliver said steam into a substantially vertically extending space to be cleaned progressively from a high point to a lower point, connecting said vacuum source by a hose to a fitting at a low point in said space, actuating said sources to loosen debris from the walls of said space and to collect the loosened debris therefrom by vacuum, the method including providing said fitting with a scoop adapted to intercept falling debris and to facilitate the entry of the debris into the hose.

2. The method of cleaning the chimney flue of a heating furnace which is connected to the flue by a furnace pipe which includes providing a source of detergent-bearing steam under pressure, providing a source of high volume wet-and-dry vacuum, replacing the furnace pipe connection to the flue by a fitting connecting a hose from the vacuum source to the flue, actuating said sources to supply steam and to remove debris, conducting the steam to a point adjacent the top of the flue and delivering it progressively from said top point to a point adjacent the vacuum connection, said fitting having a scoop adapted to occlude a substantial area of the flue for intercepting falling debris and directing such debris into the vacuum hose.

3. The method of cleaning a fireplace flue and open fireplace which includes, providing a source of detergent-bearing steam under pressure, providing a source of high volume wet-and-dry vacuum, sealing the fireplace opening by means of a tight fitting shield provided with two access openings, connecting the vacuum source to one of said shield openings, actuating said souces to supply steam and to pick up and remove debris, conducting the steam to a point adjacent the top of the flue and delivering it progressively from said point to a point adjacent the bottom of the flue, thereafter conducting the steam to the other of said shield openings, and actuating the steam flow and vacuum pickup to complete cleaning of the fireplace, the bottom of the flue being provided with a damper and the damper being closed before the stop of conducting steam to said other opening.

4. A fitting for connecting a vacuum hose to a chimney flue having a circular lateral opening, comprising an annular collar fitting snugly into said opening, an annular flange on the collar and a scoop mounted on the collar and adapted to pass through the opening and to occlude a substantial proportion of the cross-sectional area of the flue.

5. A fitting according to claim 4 wherein the scoop is an integral extension of the lower portion of the collar.

* * * * *